US012187494B2

(12) United States Patent
Liang

(10) Patent No.: US 12,187,494 B2
(45) Date of Patent: Jan. 7, 2025

(54) ANTI-POLLUTION BOTTLE CAP

(71) Applicant: Guangzhou Shanggong Plastic Co.,Ltd, Guangzhou (CN)

(72) Inventor: Qi Quan Liang, Guangzhou (CN)

(73) Assignee: Guangzhou Shanggong Plastic Co., Ltd, Guangzhou (CN)

( * ) Notice: Subject to any disclaimer, the term of this patent is extended or adjusted under 35 U.S.C. 154(b) by 0 days.

(21) Appl. No.: 17/284,807

(22) PCT Filed: Jan. 12, 2021

(86) PCT No.: PCT/CN2021/071316
§ 371 (c)(1),
(2) Date: Apr. 13, 2021

(87) PCT Pub. No.: WO2022/126811
PCT Pub. Date: Jun. 23, 2022

(65) Prior Publication Data

US 2023/0219719 A1 Jul. 13, 2023

(30) Foreign Application Priority Data

Dec. 14, 2020 (CN) ..... 202011466351.3

(51) Int. Cl.
*B65D 47/20* (2006.01)
*B65D 35/46* (2006.01)
(Continued)

(52) U.S. Cl.
CPC ..... *B65D 35/46* (2013.01); *B65D 41/105* (2013.01); *B65D 47/0804* (2013.01); *B65D 49/10* (2013.01)

(58) Field of Classification Search
CPC .... B65D 49/10; B65D 41/0804; B65D 35/46; B65D 47/2031; B65D 47/32; B65D 47/2018; B65D 47/2081; B65D 47/06
(Continued)

(56) References Cited

U.S. PATENT DOCUMENTS 5,045,077 A * 9/1991 Blake, III ..... A61M 1/60 128/205.12
5,169,035 A * 12/1992 Imbery, Jr. ..... B65D 51/1644 222/481.5

(Continued)

*Primary Examiner* — Charles P. Cheyney
(74) *Attorney, Agent, or Firm* — Pilloff Passino & Cosenza LLP; Rachel Pilloff; Sean Passino

(57) ABSTRACT

The disclosure provides an anti-pollution bottle cap comprising a cap body, a liquid drainage one-way valve and an air intake one-way valve. A liquid drainage hole and an air intake hole are disposed in the cap body and both communicated with an inside of the cap body. The liquid drainage one-way valve is disposed in a space enclosed by the cap body. The liquid drainage hole is blocked by the liquid drainage one-way valve in one way so as to be opened during toppling operation. The air intake one-way valve is disposed in the space enclosed by the cap body. The air intake hole is blocked by the air intake one-way valve in one way so as to be closed during toppling operation. In application, the anti-pollution bottle cap will be installed on a bottle for matched use, so that a user can normally drain liquid through the liquid drainage hole only by squeezing the bottle. When use is stopped, through blockage of the liquid drainage one-way valve to the liquid drainage hole, adherends on the body surface of the user are prevented from entering the bottle, contents will not be polluted, and the problem that an existing bottle cap is likely to pollute contents is practically solved.

9 Claims, 8 Drawing Sheets

(51) Int. Cl.
*B65D 41/10* (2006.01)
*B65D 47/08* (2006.01)
*B65D 49/10* (2006.01)

(58) Field of Classification Search
USPC ..... 222/213, 212, 494, 482, 490, 481
See application file for complete search history.

(56) References Cited

U.S. PATENT DOCUMENTS

| | | | | |
|---|---|---|---|---|
| 5,390,828 | A * | 2/1995 | Gross | B65D 47/26 222/481.5 |
| 6,832,706 | B2 * | 12/2004 | Hearld | B65D 47/0828 222/482 |
| 9,296,531 | B2 * | 3/2016 | Luzbetak | B65D 47/248 |
| 9,889,966 | B2 * | 2/2018 | Medeiros | B65D 23/02 |
| 10,189,614 | B2 * | 1/2019 | Pruiett | B65D 47/32 |
| 10,308,403 | B2 * | 6/2019 | Hashimoto | B65D 41/04 |
| 10,799,046 | B2 * | 10/2020 | Zhang | B65D 47/2031 |
| 11,109,708 | B2 * | 9/2021 | Lecomte | B67D 1/0085 |
| 2011/0290824 | A1 * | 12/2011 | Smith | B65D 47/2025 222/129 |
| 2016/0235229 | A1 * | 8/2016 | Löhn | B65D 47/06 |
| 2020/0062476 | A1 * | 2/2020 | Katayama | B65D 47/2081 |

* cited by examiner

ANTI-POLLUTION BOTTLE CAP

TECHNICAL FIELD

The disclosure relates to the technical field of bottle caps, in particular to an anti-pollution bottle cap.

RELATED ART

Using a bottle to contain liquid is a common storage method. For example, a plurality of cosmetics are liquid products, and after the cosmetics are contained by the bottle, the liquid can be extruded for use only by squeezing the bottle. However, in the application process, a liquid drainage hole of a bottle cap may be in contact with the application part of a user. After use is finished, adherends on the body surface of the user may enter the bottle through the liquid drainage hole, thereby polluting contents. Therefore, a technical solution capable of solving the problem is urgently needed.

SUMMARY

The disclosure aims to provide an anti-pollution bottle cap so as to solve the problem that an existing bottle cap is likely to pollute contents.

In order to solve the technical problem, the disclosure provides an anti-pollution bottle cap. The anti-pollution bottle cap comprises a cap body, a liquid drainage one-way valve and an air intake one-way valve. A liquid drainage hole and an air intake hole are disposed in the cap body and both communicated with an inside of the cap body. The liquid drainage one-way is disposed in a space enclosed by the cap body. The liquid drainage hole is blocked by the liquid drainage one-way valve in one way so as to be opened during toppling operation. The air intake one-way valve is disposed in the space enclosed by the cap body. The air intake hole is blocked by the air intake one-way valve in one way so as to be closed during toppling operation.

In one embodiment, a liquid drainage cavity and an air intake cavity are disposed in the cap body. The liquid drainage cavity is communicated with the liquid drainage hole. The air intake cavity is communicated with the air intake hole. The anti-pollution bottle cap further comprises a support. The support comprises a liquid drainage frame body and an air intake frame body. The liquid drainage frame body is embedded into the liquid drainage cavity in an enclosing and blocking mode. The liquid drainage frame body is provided with a liquid guide hole. The liquid guide hole is communicated with the liquid drainage cavity. The liquid guide hole is closed by the liquid drainage one-way valve in one way. The air intake frame body is embedded into the air intake cavity in an enclosing and blocking mode. The air intake frame body is provided with an air guide hole. The air guide hole is communicated with the air intake cavity. The air guide hole is closed by the air intake one-way valve in one way.

In one embodiment, the liquid drainage one-way valve comprises a liquid drainage blocking core and a flexible rubber separation blade. One end of the liquid drainage blocking core abuts against an inner top wall of the cap body. The other end of the liquid drainage blocking core penetrates into the liquid guide hole. A diameter of the liquid drainage blocking core is smaller than a hole diameter of the liquid guide hole. The flexible rubber separation blade is disposed in the liquid drainage cavity. The flexible rubber separation blade is disposed around the liquid drainage blocking core in a circumferential direction by a circle. The flexible rubber separation blade extends out of a circumferential direction of the liquid guide hole so as to block communication between the liquid guide hole and the liquid drainage hole. The flexible rubber separation blade is bent under pressure for communicating the liquid guide hole with the liquid drainage hole.

In one embodiment, the air intake one-way valve comprises a guide column and a sealing cover. The guide column and the sealing cover are connected with each other. A diameter of the guide column is smaller than a hole diameter of the air guide hole. The guide column penetrates through the air guide hole. Stop blocks are disposed at portions, in the air intake cavity, of the guide column. The stop blocks extend towards an outside of a circumferential direction of the air guide hole. The stop blocks are configured to abut against the air intake frame body to prevent the air intake one-way valve from separating. The sealing cover is disposed outside the air intake cavity. The sealing cover is separated from the air intake frame body. The sealing cover can be stressed and deformed in toppling operation so as to close the air guide hole.

In one embodiment, a liquid drainage cavity is disposed in the cap body and communicated with the liquid drainage hole. The anti-pollution bottle cap further comprises a liquid drainage frame body. The liquid drainage frame body is embedded into the liquid drainage cavity in an enclosing and blocking mode. The liquid drainage frame body is provided with a liquid guide hole. The liquid guide hole is communicated with the liquid drainage cavity. The liquid drainage one-way valve comprises a liquid drainage blocking core and a flexible rubber separation blade. One end of the liquid drainage blocking core abuts against an inner top wall of the cap body. The other end of the liquid drainage blocking core penetrates into the liquid guide hole. A diameter of the liquid drainage blocking core is smaller than a hole diameter of the liquid guide hole. The flexible rubber separation blade is disposed in the liquid drainage cavity. The flexible rubber separation blade is disposed around the liquid drainage blocking core in a circumferential direction by a circle. The flexible rubber separation blade extends out of a circumferential direction of the liquid guide hole so as to block communication between the liquid guide hole and the liquid drainage hole. The flexible rubber separation blade is bent under pressure for communicating the liquid guide hole with the liquid drainage hole.

In one embodiment, an air intake cavity is disposed in the cap body and communicated with the air intake hole. The anti-pollution bottle cap further comprises an air intake frame body. The air intake frame body is embedded into the air intake cavity in an enclosing and blocking mode. The air intake frame body is provided with an air guide hole. The air guide hole is communicated with the air intake cavity. The air intake one-way valve comprises a guide column and a sealing cover. The guide column and the sealing cover are connected with each other. A diameter of the guide column is smaller than a hole diameter of the air guide hole. The guide column penetrates through the air guide hole. Stop blocks are disposed at portions, in the air intake cavity, of the guide column. The stop blocks extend towards an outside of a circumferential direction of the air guide hole. The stop blocks are configured to abut against the air intake frame body to prevent the air intake one-way valve from separating. The sealing cover is disposed outside the air intake cavity. The sealing cover is separated from the air intake frame body. The sealing cover can be stressed and deformed in toppling operation so as to close the air guide hole.

In one embodiment, an inner step is disposed on an inner wall of the liquid guide hole. The inner step is disposed around the inner wall of the liquid guide hole in a circumferential direction by a circle, so that the hole diameter of the liquid guide hole is gradually decreased in a direction away from the liquid drainage hole.

In one embodiment, the hole diameter of the air guide hole is gradually increased linearly in a direction away from the air intake hole.

In one embodiment, the air guide hole is in a cross shape. The stop blocks are disposed on two opposite sides of the guide column, respectively.

In one embodiment, the cap body is connected with a flipping cap capable of being opened and closed by flipping. Closing by flipping of the flipping cap is configured to surround and close the liquid drainage hole and the air intake hole.

The disclosure has the following beneficial effects:

In application, the anti-pollution bottle cap will be installed on a bottle for matched use. Because the liquid drainage one-way valve is disposed in the space enclosed by the cap body, and the liquid drainage hole is blocked by the liquid drainage one-way valve in one way so as to be opened during toppling operation, a user can normally drain liquid through the liquid drainage hole only by squeezing the bottle. When use is stopped, through blockage of the liquid drainage one-way valve to the liquid drainage hole, adherends on the body surface of the user are prevented from entering the bottle, contents will not be polluted, and the problem that an existing bottle cap is likely to pollute the contents is practically solved.

BRIEF DESCRIPTION OF THE DRAWINGS

To describe the technical solutions of the disclosure more clearly, the following briefly describes accompanying drawings required for describing the embodiments.

Apparently, the following described accompanying drawings are only some of the embodiments of the disclosure, and those of ordinary skill in the art may still derive other drawings from these accompanying drawings without creative efforts.

REFERENCE NUMERALS ARE AS FOLLOWS

10 denotes a cap body, 11 denotes a liquid drainage hole, 12 denotes an air intake hole, 13 denotes a liquid drainage cavity, and 14 denotes an air intake cavity;

20 denotes a liquid drainage one-way valve, 21 denotes a liquid drainage blocking core, and 22 denotes a flexible rubber separation blade;

30 denotes an air intake one-way valve, 31 denotes a guide column, 32 denotes a sealing cover, and 33 denotes stop blocks;

40 denotes a bottle;

50 denotes a support, 51 denotes a liquid drainage frame body, 511 denotes a liquid guide hole, 512 denotes an inner step, 52 denotes an air intake frame body, and 521 denotes an air guide hole; and

60 denotes a flipping cap.

DETAILED DESCRIPTION

The following clearly and completely describes the technical solutions in the implementations of the disclosure with reference to the accompanying drawings in the implementations of the disclosure.

Figure 1:
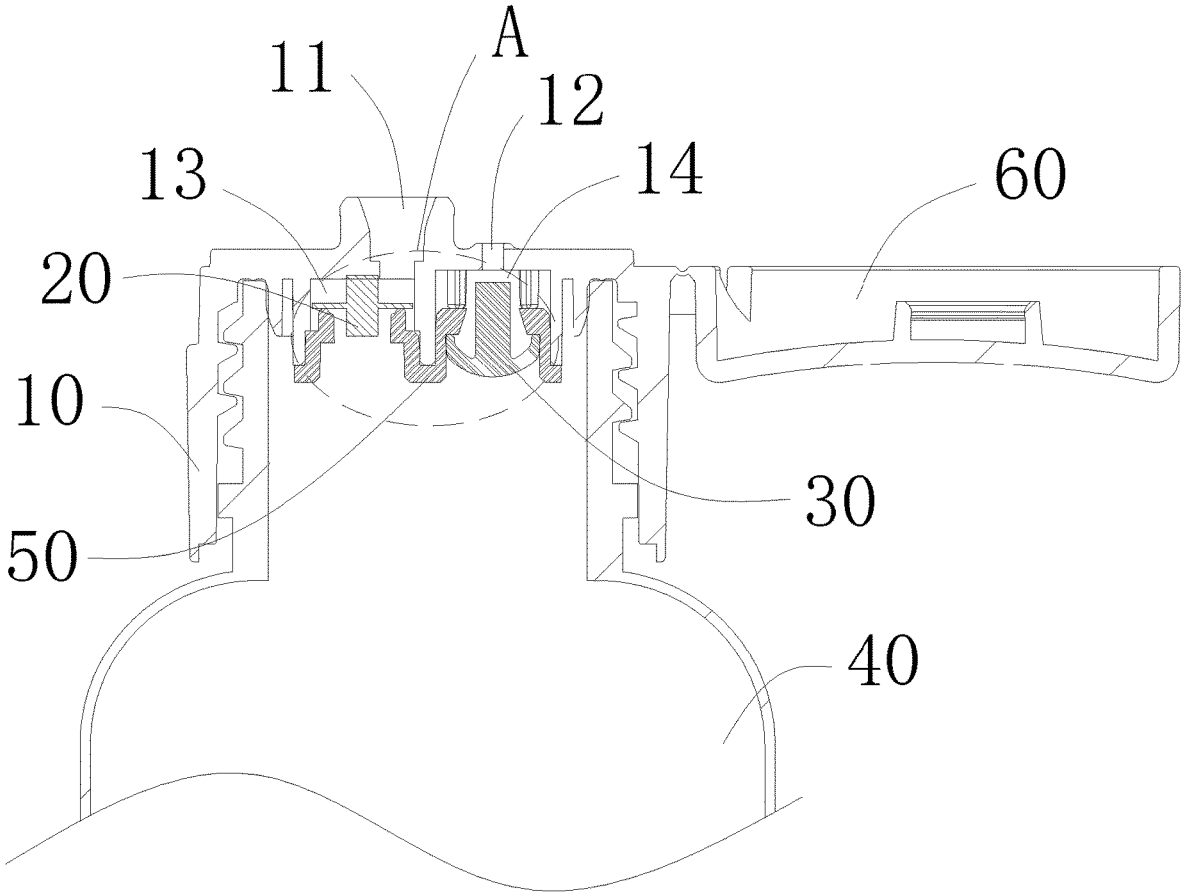
FIG. 1 is a schematic diagram of a section-view structure provided by a first embodiment of an anti-pollution bottle cap of the disclosure.
Figure 3:
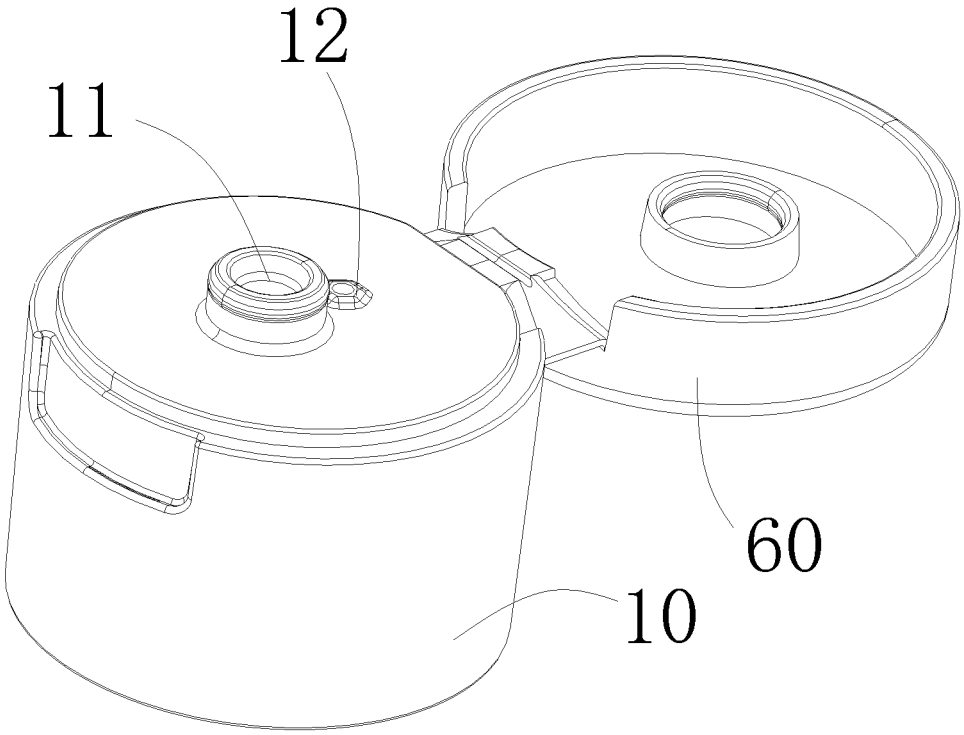
FIG. 3 is a schematic diagram of a structure of a cap body of FIG. 1.

The disclosure provides an anti-pollution bottle cap. The first embodiment of the anti-pollution bottle cap is shown in FIG. 1 and FIG. 3 and comprises a cap body 10, a liquid drainage one-way valve 20 and an air intake one-way valve 30. A liquid drainage hole 11 and an air intake hole 12 are disposed in the cap body 10, and both the liquid drainage hole 11 and the air intake hole 12 are communicated with an inside of the cap body 10. The liquid drainage one-way valve 20 is disposed in a space enclosed by the cap body 10. The liquid drainage hole 11 is blocked by the liquid drainage one-way valve 20 in one way so that the liquid drainage hole 11 is opened during toppling operation. The air intake one-way valve 30 is disposed in the space enclosed by the cap body 10. The air intake hole 12 is blocked by the air intake one-way valve 30 in one way so that the air intake hole 12 is closed during toppling operation.

In application, the anti-pollution bottle cap will be installed on a bottle 40 for matched use. After the bottle 40 is made to topple, a user only needs to squeeze the bottle 40. The liquid drainage one-way valve 20 will relieve blockage to the liquid drainage hole 11. The air intake one-way valve 30 will block the air intake hole 12. Liquid can be normally drained from the liquid drainage hole 11. While, after use is stopped, the air intake one-way valve 30 relieves blockage to the air intake hole 12. Air pressure in the bottle is recovered. Through blockage of the liquid drainage one-way valve 20 to the liquid drainage hole 11, adherends on the body surface of the user are prevented from entering the bottle. Contents are not be polluted. The problem that an existing bottle cap is likely to pollute contents is practically solved.

Figure 2:
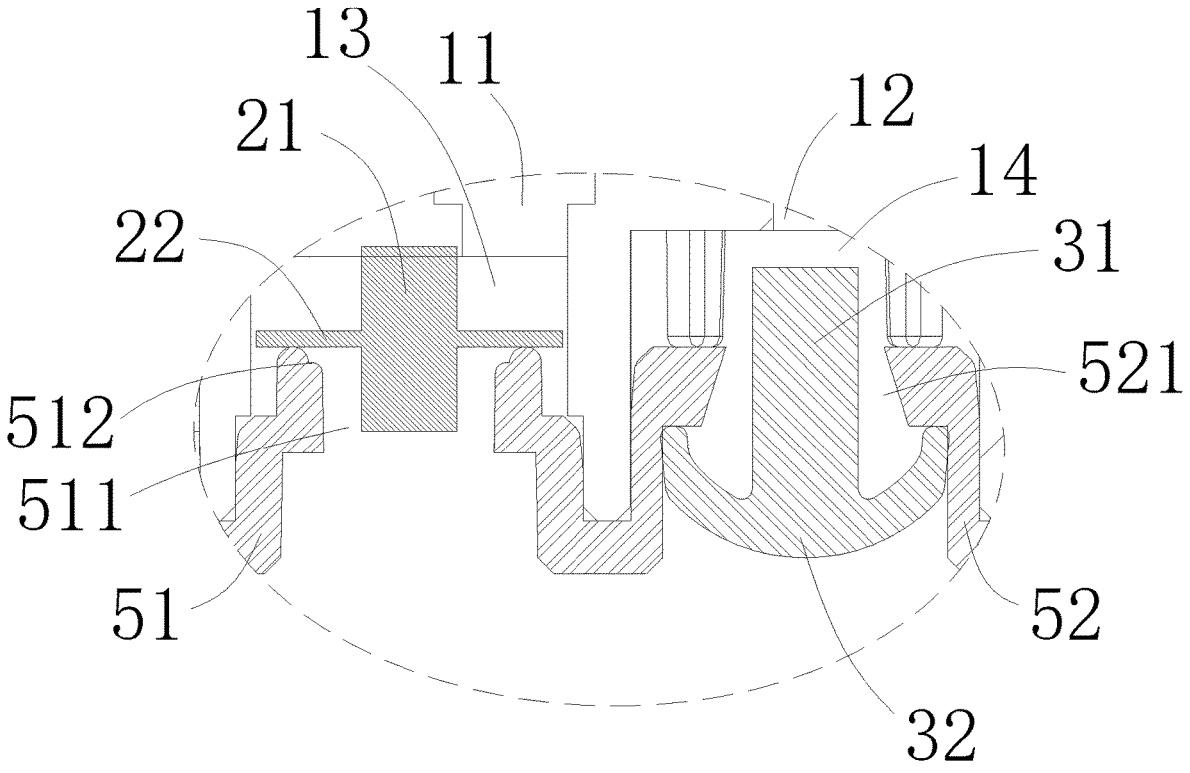
FIG. 2 is a schematic diagram of a structure of part A of FIG. 1.

As shown in FIG. 1 and FIG. 2, a liquid drainage cavity 13 and an air intake cavity 14 are disposed in the cap body 10. The liquid drainage cavity 13 is communicated with the liquid drainage hole 11. The air intake cavity 14 is communicated with the air intake hole 12. The anti-pollution bottle cap further comprises a support 50. The support 50 comprises a liquid drainage frame body 51 and an air intake frame body 52. The liquid drainage frame body 51 is embedded into the liquid drainage cavity 13 in an enclosing and blocking mode. The liquid drainage frame body 51 is provided with a liquid guide hole 511. The liquid guide hole 511 is communicated with the liquid drainage cavity 13. The liquid guide hole 511 is closed by the liquid drainage one-way valve 20 in one way. The air intake frame body 52 is embedded into the air intake cavity 14 in an enclosing and blocking mode. The air intake frame body 52 is provided with an air guide hole 521. The air guide hole 521 is communicated with the air intake cavity 14. The air guide hole 521 is closed by the air intake one-way valve 30 in one way.

In the direction shown in FIG. 1 and FIG. 2, the liquid drainage cavity 13 and the air intake cavity 14 are disposed left and right side by side. Both the liquid drainage cavity 13 and the air intake cavity 14 are enclosed to be of a cylindrical tube-shaped structure. While the liquid drainage frame body 51 and the air intake frame body 52 are of a structure like a cylinder. The two are inserted into the liquid drainage cavity 13 and the air intake cavity 14 in a matched mode, respectively. In this way, the liquid drainage cavity 13 and the air intake cavity 14 are enclosed. It is also convenient for installation of the liquid drainage one-way valve 20 and the air intake one-way valve 30.

Figure 4:
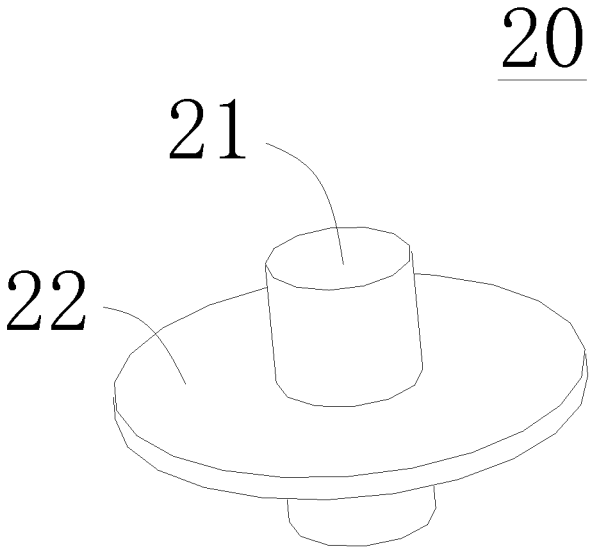
FIG. 4 is a schematic diagram of a structure of a liquid drainage one-way valve of FIG. 1.

As shown in FIG. 1, FIG. 2 and FIG. 4, the liquid drainage one-way valve 20 comprises a liquid drainage blocking core 21 and a flexible rubber separation blade 22. One end of the liquid drainage blocking core 21 abuts against an inner top wall of the cap body 10. The other end of the liquid drainage blocking core 21 penetrates into the liquid guide hole 511. A diameter of the liquid drainage blocking core 21 is smaller than a hole diameter of the liquid guide hole 511. The flexible rubber separation blade 22 is disposed in the liquid drainage cavity 13. The flexible rubber separation blade 22 is disposed around the liquid drainage blocking core 21 in a circumferential direction by a circle. The flexible rubber separation blade 22 extends out of a circumferential direction of the liquid guide hole 511 so that flexible rubber separation blade 22 blocks communication between the liquid guide hole 511 and the liquid drainage hole 11. The flexible rubber separation blade 22 is bent under pressure for communicating the liquid guide hole 511 with the liquid drainage hole 11.

When the cap body 10 is placed uprightly, the flexible rubber separation blade 22 is in an extended state. The flexible rubber separation blade 22 will completely cover the liquid guide hole 511. Accordingly, blockage from the liquid guide hole 511 to the liquid drainage hole 11 is achieved so as to prevent pollutants from entering the bottle through the liquid drainage hole 11. When liquid drainage is needed, the cap body 10 will be in a turned-over state. If the bottle 40 is squeezed, liquid will apply downward thrust to the flexible rubber separation blade 22. Accordingly, the flexible rubber separation blade 22 is made to be bent downwards to form a gap. Then, liquid can flow to the liquid drainage hole 11 to be drained.

As shown in FIG. 1 and FIG. 2, an inner step 512 is disposed on an inner wall of the liquid guide hole 511. The inner step 512 is disposed around an inner wall of the liquid guide hole 511 in a circumferential direction by a circle, so that the hole diameter of the liquid guide hole 511 is gradually decreased in a direction away from the liquid drainage hole 11.

After the structure is adopted, a space between the liquid drainage blocking core 21 and the liquid guide hole 511 is larger at a position adjacent to the flexible rubber separation blade 22. Not only can a liquid flow capacity be increased, but also it is ensured that smooth flowing of liquid also can be achieved with small deformation amplitude of the flexible rubber separation blade 22.

Figure 5:
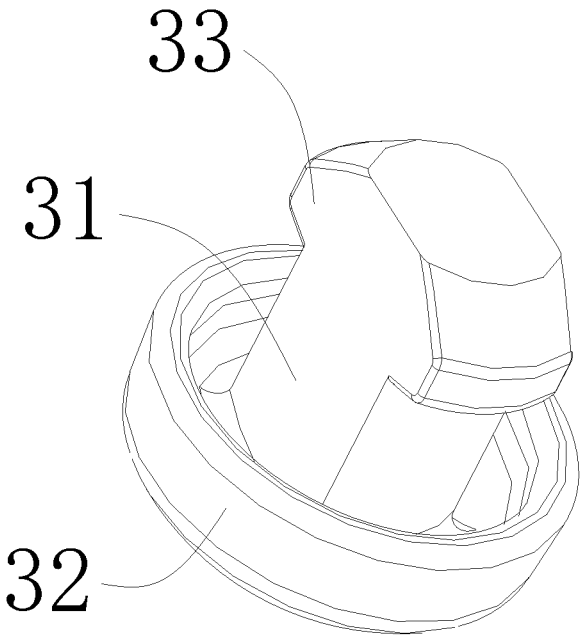
FIG. 5 is a schematic diagram of a structure of an air intake one-way valve of FIG. 1.
Figure 6:
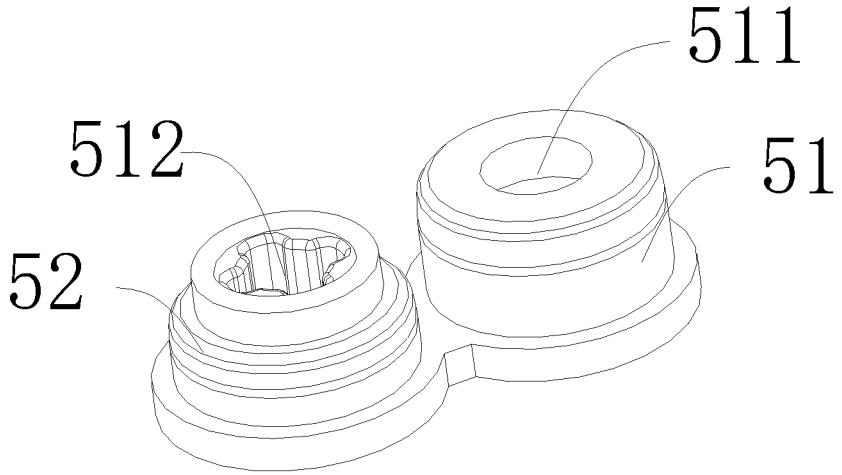
FIG. 6 is a schematic diagram of a structure of a support of FIG. 1.

As shown in FIG. 1, FIG. 2 and FIG. 5, the air intake one-way valve 30 comprises a guide column 31 and a sealing cover 32. The guide column and the sealing cover are connected with each other. A diameter of the guide column 31 is smaller than a hole diameter of the air guide hole 521. The guide column 31 penetrates through the air guide hole 521. Stop blocks 33 are disposed at portions, in the air intake cavity 14, of the guide column 31. The stop blocks 33 extend towards an outside of a circumferential direction of the air guide hole 521. The stop blocks 33 are configured to abut against the air intake frame body 52 to prevent the air intake one-way valve 30 from separating. The sealing cover 32 is disposed outside the air intake cavity 14. The sealing cover 32 is separated from the air intake frame body 52. The sealing cover 32 can be stressed and deformed in toppling operation so as to close the air guide hole 521.

The sealing cover 32 in the embodiment is approximately in a mushroom shape. When the cap body 10 is disposed uprightly, the sealing cover 32 is in an unstressed state. The sealing cover 32 is separated from the air intake frame body 52. Accordingly, it is ensured that air pressure inside the bottle body and air pressure outside the bottle body are balanced. When liquid drainage by toppling is needed, liquid will apply pressure to the sealing cover 32. The sealing cover 32 is expanded and deformed to abut against the air intake frame body 52. Accordingly, the air guide hole 521 is closed. Liquid is prevented from flowing from the air guide hole 521 to the air intake hole 12.

As shown in FIG. 2, the hole diameter of the air guide hole 521 is gradually increased linearly in a direction away from the air intake hole 12.

Taking the direction shown in the figures as an example, after the structure is adopted, the stop blocks 33 can be pushed from bottom to top conveniently till the stop blocks 33 penetrate through the air guide hole 521 so as to achieve the snap-fit mounting of the air intake one-way valve 30 and the air intake frame body 52.

As shown in FIG. 2, FIG. 4 and FIG. 5, the air guide hole 521 is in a cross shape. The stop blocks 33 are disposed on two opposite sides of the guide column 31, respectively.

Therefore, when the air intake one-way valve 30 is installed, the two stop blocks 33 will penetrate through two opposite ends of the cross shape of the air guide hole 521. The other two ends of the cross shape of the air guide hole 521 will be in an uncovered state. Accordingly, communication of airflow on two sides of the air guide hole 521 is ensured. The phenomenon that the air guide hole 521 is blocked is avoided.

As shown in FIG. 1 and FIG. 3, the cap body 10 is connected with a flipping cap 60 capable of being opened and closed by flipping. Closing by flipping of the flipping cap 60 is configured to surround and close the liquid drainage hole 11 and the air intake hole 12.

After the flipping cap 60 is additionally disposed, the flipping cap 60 is closed by flipping when the bottle is not in use as required so as to protect the liquid drainage hole 11 and the air intake hole 12.

Figure 7:
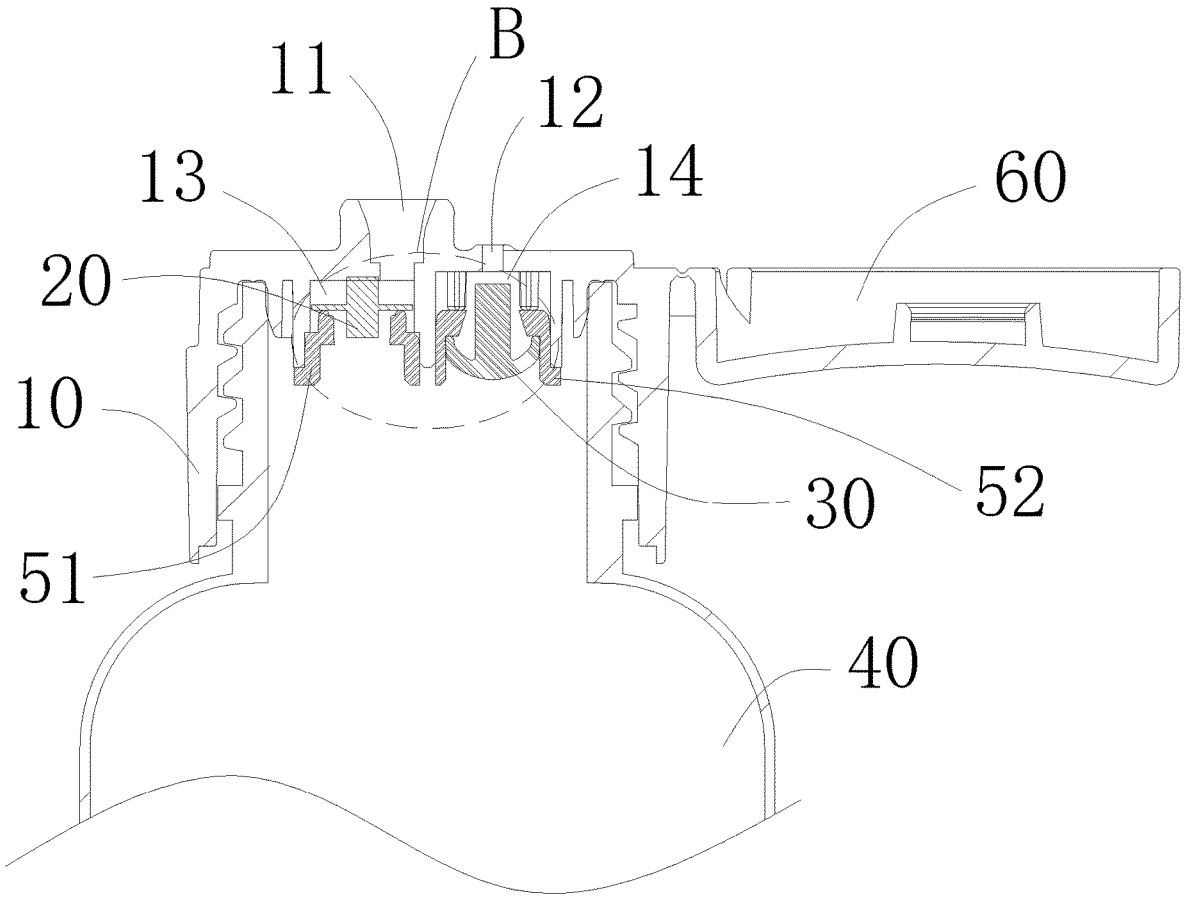
FIG. 7 is a schematic diagram of a section-view structure provided by a second embodiment of an anti-pollution bottle cap of the disclosure.
Figure 8:
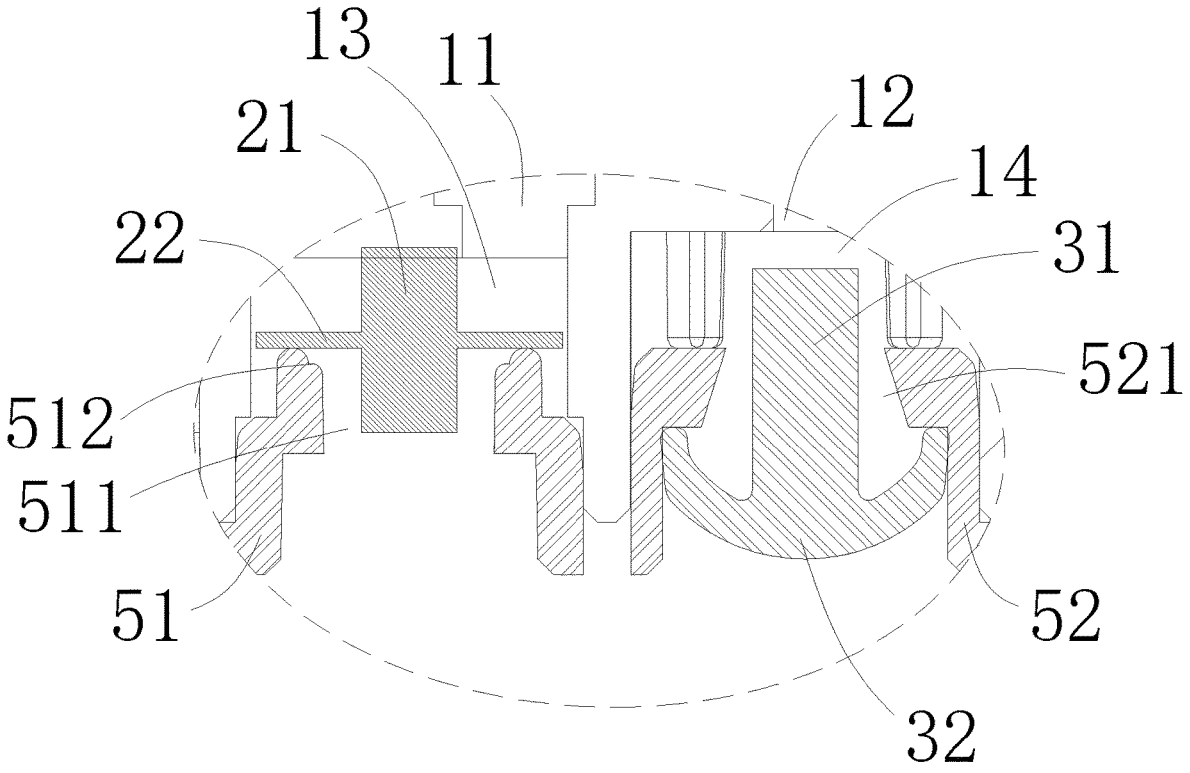
FIG. 8 is a schematic diagram of a structure of part B of FIG. 7.

The second embodiment of the anti-pollution bottle cap of the disclosure is shown in FIG. 7 and FIG. 8, and is basically consistent with the first embodiment of the anti-pollution bottle cap. Differences are as follows: a liquid drainage cavity 13 is disposed in the cap body 10, and the liquid drainage cavity 13 is communicated with the liquid drainage hole 11. The anti-pollution bottle cap further comprises a liquid drainage frame body 51. The liquid drainage frame body 51 is embedded into the liquid drainage cavity 13 in an enclosing and blocking mode. The liquid drainage frame body 51 is provided with a liquid guide hole 511. The liquid guide hole 511 is communicated with the liquid drainage cavity 13. The liquid drainage one-way valve 20 comprises a liquid drainage blocking core 21 and a flexible rubber separation blade 22. One end of the liquid drainage blocking core 21 abuts against an inner top wall of the cap body 10.

The other end of the liquid drainage blocking core 21 penetrates into the liquid guide hole 511. A diameter of the liquid drainage blocking core 21 is smaller than a hole diameter of the liquid guide hole 511. The flexible rubber separation blade 22 is disposed in the liquid drainage cavity 13. The flexible rubber separation blade 22 is disposed around the liquid drainage blocking core 21 in a circumferential direction by a circle. The flexible rubber separation blade 22 extends out of a circumferential direction of the liquid guide hole 511 so that the flexible rubber separation blade 22 blocks communication between the liquid guide hole 511 and the liquid drainage hole 11. The flexible rubber separation blade is bent under pressure for communicating the liquid guide hole 511 with the liquid drainage hole 11. An air intake cavity 14 is disposed in the cap body 10, and the air intake cavity 14 is communicated with the air intake hole 12. The anti-pollution bottle cap further comprises an air intake frame body 52. The air intake frame body 52 is embedded into the air intake cavity 14 in an enclosing and blocking mode. The air intake frame body 52 is provided with an air guide hole 521. The air guide hole 521 is communicated with the air intake cavity 14. The air intake one-way valve 30 comprises a guide column 31 and a sealing cover 32. The guide column and the sealing cover are connected with each other. A diameter of the guide column 31 is smaller than a hole diameter of the air guide hole 521. The guide column 31 penetrates through the air guide hole 521. Stop blocks 33 are disposed at portions, in the air intake cavity 14, of the guide column 31. The stop blocks 33 extend towards an outside of a circumferential direction of the air guide hole 521. The stop blocks 33 are configured to abut against the air intake frame body 52 to prevent the air intake one-way valve 30 from separating. The sealing cover 32 is disposed outside the air intake cavity 14. The sealing cover 32 is separated from the air intake frame body 52. The sealing cover 32 can be stressed and deformed in toppling operation so as to close the air guide hole 521.

That is, in this embodiment, the liquid drainage frame body 51 and the air intake frame body 52 are divided into two independent components, rather than being connected into a whole. The same functions can be achieved as well. Because functions achieved by this embodiment are basically the same as those of the first embodiment, they will not be described.

The above mentioned are preferred implementations of the disclosure. It should be noted that several improvements and refinements may be made by those of ordinary skill in the art without departing from the principles of the disclosure, and these improvements and refinements are also to be considered within the scope of the disclosure.

The invention claimed is:

1. An anti-pollution bottle cap, wherein the anti-pollution bottle cap comprises a cap body, a liquid drainage one-way valve and an air intake one-way valve;

a liquid drainage hole and an air intake hole are disposed in the cap body and both communicated with an inside of the cap body;

the liquid drainage one-way is disposed in a space enclosed by the cap body, and the liquid drainage hole is blocked by the liquid drainage one-way valve in one way so as to be opened during toppling operation; and the air intake one-way valve is disposed in the space enclosed by the cap body, and the air intake hole is blocked by the air intake one-way valve so as to be closed during toppling operation, wherein a liquid drainage cavity and an air intake cavity are disposed in the cap body, the liquid drainage cavity is communicated with the liquid drainage hole, and the air intake cavity is communicated with the air intake hole;

the anti-pollution bottle cap further comprises a support, and the support comprises a liquid drainage frame body and an air intake frame body;

the liquid drainage frame body is embedded into the liquid drainage cavity in an enclosing and blocking mode, the liquid drainage frame body is provided with a liquid guide hole, and the liquid guide hole is communicated with the liquid drainage cavity and closed by the liquid drainage one-way valve in one way; and the air intake frame body is embedded into the air intake cavity in an enclosing and blocking mode, the air intake frame body is provided with an air guide hole, and the air guide hole is communicated with the air intake cavity and closed by the air intake one-way valve in one way;

wherein the liquid drainage one-way valve comprises a liquid drainage blocking core and a flexible rubber separation blade;

one end of the liquid drainage blocking core abuts against an inner top wall of the cap body, the other end of the liquid drainage blocking core penetrates into the liquid guide hole, and a diameter of the liquid drainage blocking core is smaller than a hole diameter of the liquid guide hole; and the flexible rubber separation blade is disposed in the liquid drainage cavity, the flexible rubber separation blade is disposed around the liquid drainage blocking core in a circumferential direction by a circle, the flexible rubber separation blade extends out of a circumferential direction of the liquid guide hole so as to block communication between the liquid guide hole and the liquid drainage hole, and the flexible rubber separation blade is bent under pressure for communicating the liquid guide hole with the liquid drainage hole, wherein the air intake one-way valve comprises a guide column and a sealing cover and the guide column and the sealing cover are connected with each other;

a diameter of the guide column is smaller than a hole diameter of the air guide hole, the guide column penetrates through the air guide hole, stop blocks are disposed at portions, in the air intake cavity of, the guide column, the stop blocks extend towards the outside of a circumferential direction of the air guide hole, and the stop blocks are configured to abut against the air intake frame body to prevent the air intake one-way valve from separating; and the sealing cover is disposed outside the air intake cavity, the sealing cover is separated from the air intake frame body, and the sealing cover can be stressed and deformed in toppling operation so as to close the air guide hole.

2. The anti-pollution bottle cap according to claim 1, wherein a liquid drainage cavity is disposed in the cap body and communicated with the liquid drainage hole;

the anti-pollution bottle cap further comprises a liquid drainage frame body, the liquid drainage frame body is embedded into the liquid drainage cavity in an enclosing and blocking mode, the liquid drainage frame body is provided with a liquid guide hole, and the liquid guide hole is communicated with the liquid drainage cavity;

the liquid drainage one-way valve comprises a liquid drainage blocking core and a flexible rubber separation blade;

one end of the liquid drainage blocking core abuts against an inner top wall of the cap body, the other end of the liquid drainage blocking core penetrates into the liquid guide hole, and a diameter of the liquid drainage blocking core is smaller than a hole diameter of the liquid guide hole; and the flexible rubber separation blade is disposed in the liquid drainage cavity, the flexible rubber separation blade is disposed around the liquid drainage blocking core in a circumferential direction by a circle, the flexible rubber separation blade extends out of a circumferential direction of the liquid guide hole so as to block communication between the liquid guide hole and the liquid drainage hole, and the flexible rubber separation blade is bent under pressure for communicating the liquid guide hole with the liquid drainage hole.

3. The anti-pollution bottle cap according to claim 1, wherein an air intake cavity is disposed in the cap body and communicated with the air intake hole;

the anti-pollution bottle cap further comprises an air intake frame body, the air intake frame body is embedded into the air intake cavity in an enclosing and blocking mode, the air intake frame body is provided with an air guide hole, and the air guide hole is communicated with the air intake cavity;

the air intake one-way valve comprises a guide column and a sealing cover, and the guide column and the sealing cover are connected with each other;

a diameter of the guide column is smaller than a hole diameter of the air guide hole, the guide column penetrates through the air guide hole, stop blocks are disposed at portions, in the air intake cavity, of the guide column, the stop blocks extend towards the outside of a circumferential direction of the air guide hole, and the stop blocks are configured to abut against the air intake frame body to prevent the air intake one-way valve from separating; and the sealing cover is disposed outside the air intake cavity, the sealing cover is separated from the air intake frame body, and the sealing cover can be stressed and deformed in toppling operation so as to close the air guide hole.

4. The anti-pollution bottle cap according to claim 1, wherein an inner step is disposed on an inner wall of the liquid guide hole, and the inner step is disposed around an inner wall of the liquid guide hole in a circumferential direction by a circle, so that the hole diameter of the liquid guide hole is gradually decreased in a direction away from the liquid drainage hole.

5. The anti-pollution bottle cap according to claim 1, wherein the hole diameter of the air guide hole is gradually increased linearly in a direction away from the air intake hole.

6. The anti-pollution bottle cap according to claim 5, wherein the air guide hole is in a cross shape, and the stop blocks are disposed on two opposite sides of the guide column, respectively.

7. The anti-pollution bottle cap according to claim 1, wherein the cap body is connected with a flipping cap capable of being opened and closed by flipping, and closing by flipping of the flipping cap is configured to surround and close the liquid drainage hole and the air intake hole.

8. The anti-pollution bottle cap according to claim 2, wherein an inner step is disposed on an inner wall of the liquid guide hole, and the inner step is disposed around an inner wall of the liquid guide hole in a circumferential direction by a circle, so that the hole diameter of the liquid guide hole is gradually decreased in a direction away from the liquid drainage hole.

9. The anti-pollution bottle cap according to claim 3, wherein the hole diameter of the air guide hole is gradually increased linearly in a direction away from the air intake hole.

* * * * *